US009207027B1

(12) United States Patent
Hannan et al.

(10) Patent No.: US 9,207,027 B1
(45) Date of Patent: Dec. 8, 2015

(54) RIFLE DRY-FIRE APPARATUS AND METHOD

(71) Applicants: Karl E. Hannan, Pittsfield, NH (US); William Jeff Marshall, Northfield, NH (US)

(72) Inventors: Karl E. Hannan, Pittsfield, NH (US); William Jeff Marshall, Northfield, NH (US)

( * ) Notice: Subject to any disclaimer, the term of this patent is extended or adjusted under 35 U.S.C. 154(b) by 0 days.

(21) Appl. No.: 14/634,103

(22) Filed: Feb. 27, 2015

Related U.S. Application Data

(62) Division of application No. 14/313,497, filed on Jun. 24, 2014.

(60) Provisional application No. 61/844,217, filed on Jul. 9, 2013.

(51) Int. Cl.

| | |
|---|---|
| ***F41C 7/00*** | (2006.01) |
| ***F41A 3/66*** | (2006.01) |
| ***F41A 19/10*** | (2006.01) |
| ***F41A 19/14*** | (2006.01) |
| ***F41A 3/12*** | (2006.01) |

(52) U.S. Cl.
CPC ... *F41A 3/66* (2013.01); *F41A 3/12* (2013.01); *F41A 19/10* (2013.01); *F41A 19/14* (2013.01)

(58) Field of Classification Search
CPC ..... F41A 19/01; F41A 33/00
See application file for complete search history.

(56) References Cited

U.S. PATENT DOCUMENTS

| | | | | |
|---|---|---|---|---|
| 5,680,724 | A * | 10/1997 | Peterken | 42/70.11 |
| 6,470,615 | B1 * | 10/2002 | Peterken | 42/70.01 |
| 7,753,679 | B1 * | 7/2010 | Schuetz | 434/16 |
| 8,602,785 | B2 * | 12/2013 | Jensen et al. | 434/18 |
| 2002/0100201 | A1 * | 8/2002 | Keenan et al. | 42/54 |
| 2005/0260545 | A1 * | 11/2005 | Schavone | 434/18 |
| 2011/0047847 | A1 * | 3/2011 | Hughes et al. | 42/1.01 |
| 2011/0061523 | A1 * | 3/2011 | Webb | 89/128 |
| 2013/0108991 | A1 * | 5/2013 | Walls | 434/24 |
| 2014/0196267 | A1 * | 7/2014 | Tiberius et al. | 29/401.1 |

* cited by examiner

*Primary Examiner* — Gabriel Klein
(74) *Attorney, Agent, or Firm* — Mesmer & Deleault PLLC; Ross K. Krutsinger

(57) ABSTRACT

A rifle lower receiver has a trigger well and a magazine well. A hammer is disposed in the trigger well and configured to pivot from a first hammer position to a second hammer position in response to moving a trigger from a first trigger position to a second trigger position. A gear member attached to the lower receiver has a predefined number of gear teeth and a locking pin extending from the gear member. A pawl is connected to the trigger and operationally engages the gear member to increment the gear member once per trigger pull. Upon reaching a predefined number of trigger pulls, the locking member locks the trigger. A release lever on the lower receiver is operably configured to advance the gear member one increment to unlock the trigger. A method of dry-fire training is also disclosed.

9 Claims, 12 Drawing Sheets

Figure 1 - *Prior Art*

RIFLE DRY-FIRE APPARATUS AND METHOD

BACKGROUND OF THE INVENTION

1. Field of the Invention

The present invention relates generally to firearms and more particularly to a dry-fire firearms training device and method of dry fire training.

2. Description of the Prior Art

Firearms safety is an ongoing concern for both owners and non-owners of firearms. One way to improve firearms safety is for personnel to use proper technique and safely handle firearms. Currently, however, the US firearms industry is constrained by foreign wars and increased attention on public and personal safety. These factors have produced periods of shortages in popular ammunition as well as increased sales of firearms throughout the U.S. Ammunition for AR-type rifles is approximately $1 per round. With military training exercises using approximately 30,000 rounds per soldier in one week, training and instruction costs using live ammunition are very high.

During times of increased small arms market activity, training remains a constant source of financial concern for civilians, law enforcement organizations, and the military. To date, many companies have presented training solutions that address the issues of rising training costs, logistics associated with planning firearms training events, and the safety of instruction cadre and safety support personnel. Under current standards, inexperienced personnel are instructed and trained in weapons manipulation and marksmanship fundamentals using dry-fire principles.

One approach to dry-fire training devices is a pistol made by Glock, known as the Shot Indicating Resetting Trigger Training Pistol (SIRT). The SIRT pistol is designed to improve shooting accuracy by providing a cost-conscious, safe, training pistol designed to complement, but not replace, live-fire training for law enforcement professionals. The SIRT pistol is made of steel and has the look and feel of the real live-fire pistol. It matches the size, weight, and center of gravity of a live-fire pistol and may be customized with features that include magazine cartridge changes and replaceable sights. The SIRT pistol is different from other live-fire or Airsoft® pistols in that it provides instant performance feedback without the ongoing need to supply ammunition and targets. The SIRT pistol is useful to improve shooting accuracy, sidearm handling, live course programs, and training scenarios. Because the SIRT pistol does not discharge any type of projectile, it can be used safely in nearly every environment and situation. As a pistol, the SIRT training pistol is of little use for training and instruction with rifles.

For rifles, the current standard is to use a fully-operational firearm in dry-fire and live-fire exercises to instruct and train inexperienced personnel. Rifle dry-fire training principles focus on manipulating the trigger while controlling breathing, stock weld, cheek weld, sight alignment, and sight picture.

FIG. 1 shows an example of a live-fire AR-15 rifle 10 of the prior art. Rifle 10 includes an upper receiver 12 and a lower receiver 14. Upper receiver 12 includes a barrel 16 and a chamber 18 with a bolt carrier assembly 20. Bolt carrier assembly 20 (a.k.a. bolt carrier group) includes a bolt carrier, a bolt, and a firing pin. A charging handle 38 engages the bolt to move the bolt to an open position to chamber a round into chamber 18. Lower receiver 14 includes a magazine assembly 26, trigger mechanism 28, pistol grip 30, and a buttstock 32. To fire rifle 10, the user begins by inserting a loaded magazine 34 into the magazine well 36. The user then charges the rifle by pulling the charging handle 38 backwards. When charging handle 38 is in the open position (pulled back) it also draws bolt carrier assembly 20 backwards towards buttstock 32, allowing a round to enter chamber 18. When no round is in chamber 18, carrier assembly and charging handle 38 are locked in the open position until the user depresses a bolt release lever 40 (not visible) on the left side of the rifle 10 to release bolt 22 forward. With a round chambered, bolt carrier assembly 20 with charging handle 38 returns to the closed (forward) position and the rifle is ready to fire.

The user then positions rifle 10 with a proper cheek weld and stock weld and then establishes a sight alignment and sight picture. Because the AR-15 is a semi-automatic rifle, the user need only manipulate trigger mechanism 28 once for each shot. After firing each round, the shell is ejected from chamber 18 as bolt 22 returns to the open position, the next round in magazine 34 enters chamber 18, and bolt 22 then returns to the closed position with rifle 10 now charged and ready to fire again. As a result, the user is able to maintain cheek weld, stock weld, sight alignment, and sight picture after each shot until all rounds in magazine 34 have been fired. After the last round from magazine 34 is fired, bolt 22 will remain in the open position, causing trigger mechanism 28 to be locked and informing the user that no ammunition remains. The user then depresses a magazine release button 40 to release magazine 34 so that rifle 10 can be reloaded with another loaded magazine 34. This live-fire sequence is repeated to develop muscle memory and establish proper firearm handling and protocol. An important part of this live-fire training sequence includes maintaining cheek weld, stock weld, sight alignment, and sight picture from one shot to the next, such as when practicing follow up shots. When the shooter dry fires a fully functioning live-fire rifle (i.e., without ammunition) to practice firearm handling and protocol, the shooter's cheek weld, stock weld, sight alignment, and sight picture must be broken after each shot. Since no round is chambered, the trigger mechanism locks each time the trigger is pulled and charging handle 38 must be pulled back to unlock the trigger.

SUMMARY OF THE INVENTION

Currently-available training devices and procedures have undesirable limitations. The SIRT training pistol is inapplicable to firearms training for rifles, such as AR-15 rifles and similar models, such as the M-4 and M-16. Also, the SIRT training pistol allows the user to continually manipulate the trigger with no indication that the user has depleted the ammunition available in a magazine or clip. Further, even if a similar training rifle were provided, the user would be training with a training rifle that is entirely separate from the user's own, customized rifle. Therefore, when the user returns to the user's own, familiar rifle for live-fire situations, the user's grips, sights, sight alignment, accessories, barrel, and other aspects of the rifle are different from the training rifle. Because of these differences, the training rifle reinforces different technique, such as sight alignment, than what is familiar to the user when using his or her own live-fire rifle.

For this reason, fully-operational live-fire rifles with live ammunition are used for training and instruction at firing ranges. However, a firing range is often not available, but the user must still maintain marksmanship skills. To do so, the user often performs dry-fire training with a fully-operational rifle, where the rifle is fired "dry" without ammunition. Dry-fire trigger manipulation has proven to be crucial in order to improve accuracy and proficiency at the individual level. Dry-fire training is used by almost all elite service units throughout the world because it provides the best marksmanship fundamental reinforcement training without the use of live ammunition.

When fully-operational rifles are used, whether using live ammunition at a range or with dry-fire training, the risk of negligent discharge always exists. This risk is heightened for training in confined areas and for undercover or clandestine operations. To reduce the risk of negligent discharge for dry-fire training, one must use a trusted safety verifier to guarantee safety. Even with a safety verifier, one not participating in the training cannot be certain if the training is being conducted safely without performing his own inspection or having full confidence in the safety verifier.

In addition to safety concerns, dry-fire training with fully-operational rifles is inconsistent with live situations. In dry-fire training, the rifle must be re-charged after each trigger manipulation because the bolt remains in the open position and the trigger is locked when no round is in the chamber. Therefore, before the user can manipulate the trigger again, the user must break his sight alignment and sight picture to re-charge the rifle by pulling back on charging handle 38 and then releasing bolt 22 forward by pressing bolt release lever 40. This procedure is inconsistent with current weapons training procedures for multiple targets or follow-up shots because it interrupts one's cheek weld, stock weld, and sight picture. This interruption interferes with and works against the user developing muscle memory for multiple shots, follow-up shots, and a feel for how many rounds remain in magazine 34. In addition, re-charging the rifle after every shot increases wear on the rifle.

Therefore, a need exists for improved training devices and methods for rifles. The present invention addresses this need by providing a rifle dry-fire training device for AR-15 and other rifles.

It is an object of the present invention to improve safety in firearms training.

It is another object of the present invention to reduce negligent firearms discharge during training.

It is a further object of the present invention to provide a realistic and safe firearms training device with operational characteristics that are consistent with a live-fire rifle.

It is still another object of the present invention to enable marksmanship training without ammunition, safety concerns, or the logistics associated with training ranges.

It is yet another object of the present invention to provide a training device that enables the user to train using one's own rifle components and upper receiver.

The present invention achieves these and other objectives by providing a rifle dry-fire device that mimics the operational characteristics of the user's own rifle.

In one embodiment, a rifle lower receiver includes a lower receiver body having a trigger well, and a magazine well that is disposed forward of the trigger well. The rifle lower receiver defines a central receiver plane that substantially bisects the trigger well and the magazine well. The lower receiver body is configured to be assembled with a rifle upper receiver having a chamber. In one embodiment, the rifle lower receiver is also configured to receive a magazine in the magazine well. A trigger assembly is connected to the lower receiver body and has at least one locked position and at least one unlocked position. The trigger assembly includes a trigger with a trigger body portion and a trigger finger portion, where the trigger body portion is disposed at least partially within the trigger well. The trigger is pivotable about a trigger axis extending substantially perpendicular to the central receiver plane between a first trigger position and a second trigger position when the trigger assembly is in the unlocked position. The trigger is biased towards the first trigger position.

A hammer is disposed in the trigger well and is pivotable about a hammer axis extending substantially perpendicularly to the central receiver plane from a first hammer position to a second hammer position in response to pivoting the trigger from the first trigger position to the second trigger position. The hammer is biased towards the first hammer position. A gear member is disposed at least partially within the trigger well. The gear member has a plurality of gear teeth and a locking member extending from the gear member. The gear member is incrementally operable through the plurality of unlocked positions and the locked position(s). In one embodiment, the gear member has a toothed wheel and incrementally rotates about a gear axis extending substantially perpendicularly to the central receiver plane A pawl is pivotably connected to the trigger body portion and extends to operably engage the gear member, where pivoting the trigger from the first trigger position to the second trigger position causes the pawl to advance the gear member one gear increment. A bolt release lever attached to the lower receiver body is operable between a neutral lever position and a first lever position. The bolt release lever is biased towards the neutral lever position. Moving the bolt release lever from the neutral lever position to the first lever position advances (e.g., rotates) the gear member one increment. When the trigger assembly is in a locked position, moving the bolt release lever from the neutral lever position to the first lever position advances the gear member to an unlocked position. Pivoting the trigger from the first trigger position to the second trigger position a predefined number of times places the trigger assembly in a locked position in which the locking member is aligned to abut the hammer, thereby preventing the trigger from pivoting.

In another embodiment, the rifle lower receiver also includes a housing at least partially disposed within the trigger well and optionally removable from the trigger well. The housing at least partially contains a trigger assembly including the hammer, the gear member, the pawl, and the trigger. In another embodiment, the housing defines a plurality of pin recesses on an inside wall surface. At least one ball spring pin on the gear member is biased to extend into the plurality of recesses, where advancing the gear member one increment changes a position of the at least one ball spring to an adjacent one of the recesses.

In another embodiment of the rifle lower receiver, the gear member is an escapement gear, a toothed wheel, a ratchet, or a toothed longitudinal bar.

In another embodiment, the rifle lower receiver includes a magazine block disposed to obstruct an upper opening of the magazine well to prevent a round from entering the chamber of the rifle upper receiver. In one embodiment, the magazine block is permanently attached to the rifle lower receiver, such as being formed as a single unit with the rifle lower receiver or being welded to the rifle lower receiver.

In another embodiment of the rifle lower receiver, the trigger has a trigger pull force from about 2 to about 8 pounds. In one embodiment, the trigger pull force is about 4 pounds.

In another embodiment of the rifle lower receiver, a bolt release pin extends from the bolt release lever, such as rearwardly towards the gear member. A gear member actuator is pivotable about an actuator axis extending substantially perpendicularly to the central receiver plane from a first actuator position to a second actuator position. The gear member actuator is biased towards the first actuator position and capable of contacting the locking member. Moving the bolt release lever from the neutral lever position to the first lever position moves the bolt release pin into engagement with the gear member actuator, thereby pivoting the gear member actuator to the second actuator position and advancing the gear member one increment.

Another aspect of the present invention is directed to a method of dry-fire training for a live-fire rifle having an upper receiver, a lower receiver, and a bolt carrier assembly. In one embodiment, the method includes providing a non-firing training receiver constructed to substitute for the lower receiver of the live-fire rifle and to assemble with the upper receiver of the live-fire rifle. In one embodiment, the non-firing training receiver includes a bolt release lever and a trigger assembly with a trigger and having a locked configuration and an unlocked configuration, where pulling the trigger a predetermined number of times changes the trigger assembly to the locked configuration and wherein actuating the bolt release lever changes the trigger assembly from the locked configuration to the unlocked configuration. The method also includes removing the lower receiver from the live-fire rifle, assembling the non-firing training receiver to the upper receiver, and pulling the trigger the pre-defined number of times to change the trigger assembly to the locked configuration. In response to the trigger assembly being in the locked configuration, the method includes actuating the bolt-release lever to change the trigger assembly to the unlocked configuration, where the trigger assembly is subsequently operable the predetermined number of times before changing again to the locked configuration.

In another embodiment, the method includes removing the bolt carrier assembly from the live-fire rifle.

In another embodiment, the method includes installing a magazine in the magazine well prior to pulling the trigger the pre-defined number of times and removing the magazine from the magazine well after pulling the trigger the pre-defined number of times.

In one embodiment of the method, the step of pulling the trigger the pre-defined number of times includes maintaining a cheek weld, a sight picture, and/or a sight alignment for at least two consecutive trigger pulls. In one embodiment of the method, the step of providing a non-firing training receiver includes selecting the pre-determined number of times having a value of least 10. In another embodiment, the pre-determined number of times equals 30.

DETAILED DESCRIPTION OF THE PREFERRED EMBODIMENT

As used in this application, "dry fire" means to pull the trigger of a firearm or firearm training apparatus and allow the hammer to drop with no ammunition in the chamber.

Figure 1:
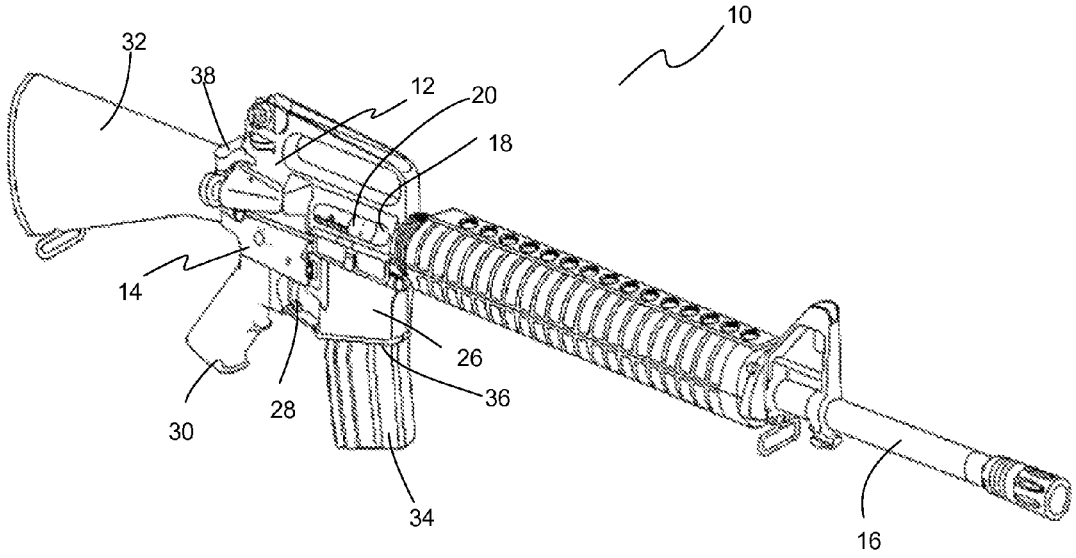
FIG. 1 is a right, front perspective illustration showing an AR-15 rifle of the prior art and including a lower receiver, an upper receiver, and bolt carrier assembly.
Figure 2:
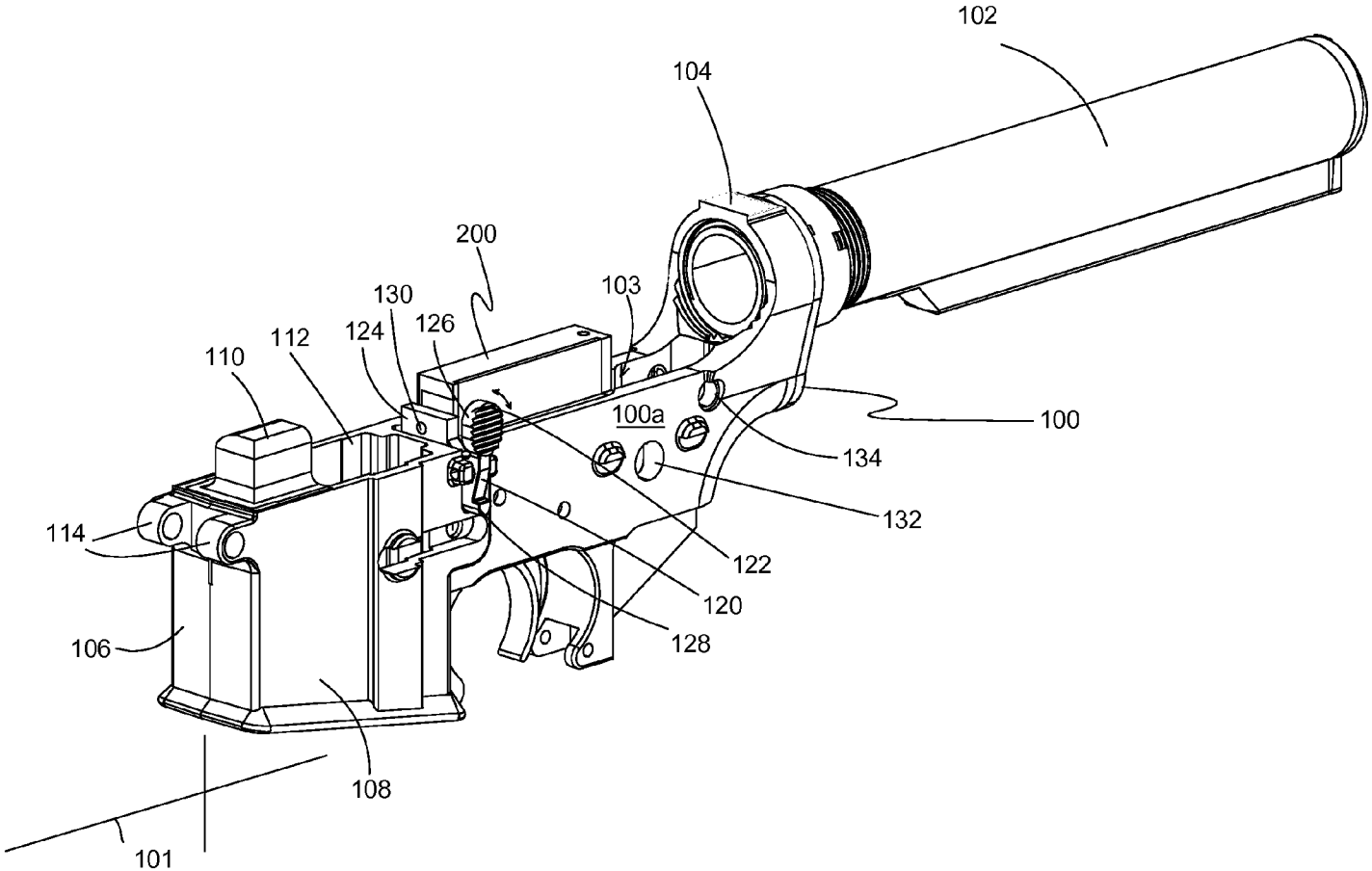
FIG. 2 illustrates a right-side, front, perspective view of a lower receiver and trigger box assembly of the present invention showing a trigger box assembly installed in the trigger well.

The preferred embodiments of the present invention are illustrated in FIGS. 2-21. FIG. 2 is a perspective view of portions of one embodiment of a lower receiver 100 with a receiver extension tube 102 attached to a rearward end portion 104 of lower receiver 100 and trigger box assembly 200 disposed in a trigger well 103 in lower receiver 100. Lower receiver 100 is adapted to assemble with the upper receiver of a live-fire rifle (e.g., rifle 10 shown in FIG. 1), substituting for the fully-functional lower receiver the live-fire rifle.

A central receiver plane 101 substantially bisects trigger well 103 and magazine well 108. Central receiver plane 101 extends vertically through lower receiver 100 when lower receiver 100 is positioned in a horizontal position with trigger well and magazine well extending substantially vertically. A buttstock (not shown) known in the art may be attached to receiver extension tube 102 (a.k.a. buffer tube). A forward end portion 106 of lower receiver 100 has a magazine well 108 with a magazine block 110 fixedly attached to an upper opening 112 of magazine well 108. Magazine block 110 obstructs upper opening 112 of magazine well 108 to prevent a round from loading into the chamber on the upper receiver portion (not shown) of an AR-15 or other rifle (not shown). Magazine block 110 further requires that a carrier bolt assembly of a live-fire rifle be removed from the upper receiver before assembling with lower receiver 100. Thus, lower receiver 100 is rendered incapable of firing live ammunition.

Forward end portion 106 has attachment points 114 for hinged attachment to an upper receiver (not shown) of a live-fire rifle using a pivot pin (not shown). Rearward end portion 104 has a takedown pin opening 134 for assembling lower receiver 100 to the upper receiver using a takedown pin (not shown). A safety selector opening 132 optionally receives a safety selector lever (not shown). Safety selector opening 132 and takedown pin opening 134 are configured as is customary in the art.

Figure 3:
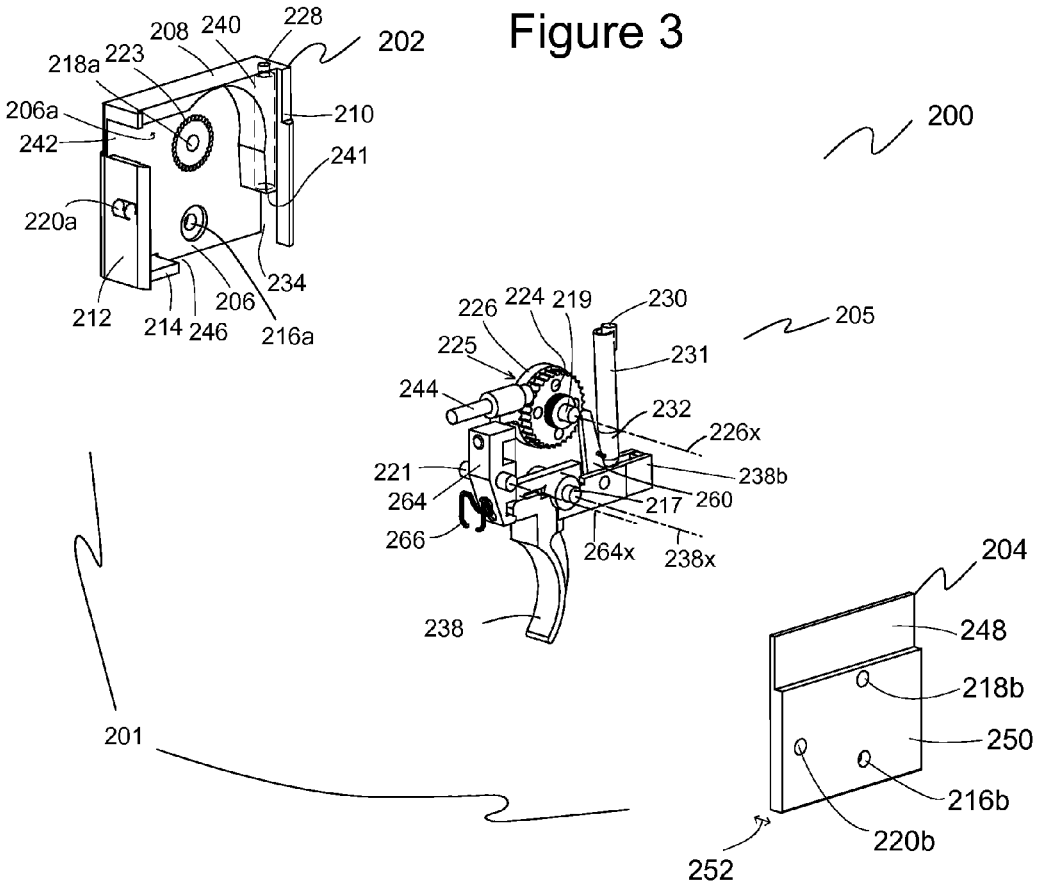
FIG. 3 illustrates an exploded right-side, front, perspective view of an embodiment of a trigger box assembly of the present invention showing a right housing portion, components of the trigger box assembly, and right housing portion in an exploded view.

A bolt release lever 120 is pivotably attached to left side 100*a* of lower receiver 100 and has a lever portion or outward portion 122 and an inward portion 124. Outward portion 122 has an upper lever part 126 and a lower lever part 128. In one embodiment, inward portion 124 has an opening 130 to a receive bolt release pin 244 (not visible), which is shown in FIG. 3 and discussed below. Bolt release lever 120 is operable between a neutral lever position and a first lever position, where bolt release lever 120 is biased to return to the neutral lever position. In one embodiment, bolt release lever 120 is a rocker-type lever where the neutral position center position. Pressing in lower lever part 128 towards lower receiver 100 (e.g., a second lever position) locks a charging handle 38 (shown e.g., in FIG. 1) in an open position. Pressing in upper lever part 126 towards lower receiver 100 (e.g., second position) pivots bolt release pin 244 (shown in FIG. 4) to advance gear member 226 and unlock trigger mechanism 205 (discussed below). Thus, selectively pressing bolt release lever 120 simulates the acts performed with a fully-operational rifle 12, in which selectively pressing bolt release lever 120 returns charging handle 38 and bolt to a forward or closed position for firing the rifle after reloading. In one embodiment, bolt release pin 244 is fixedly attached to bolt release lever 120, such as by welding, threaded engagement, or being formed as a single unit. Bolt release lever 120 may optionally include a spring-biasing mechanism that causes bolt release lever 120 to be biased to return to the neutral position. Thus, after pressing and releasing either upper lever part 226 or lower lever part 228, bolt release lever 120 returns to the neutral position.

Referring now to FIG. 3, one embodiment of trigger box assembly 200 is illustrated in an exploded right, front, perspective view. Trigger box assembly 200 includes a trigger mechanism 205 and a housing 201 with a first or right housing portion 202 and a second or left housing portion 204. Here, the terms "right" and "left" are used to be consistent with the portions of lower receiver 100 being viewed by a user operating the rifle with a buttstock against the user's shoulder and the rifle barrel extending in front of the user's body. Trigger mechanism 205 is discussed below in more detail with reference to FIG. 5.

Right housing portion 202 has a right side wall 206, a top wall portion 208, a rear wall portion 210, a front wall portion 212, and a bottom wall portion 214. Right side wall portion 206 has a right trigger pin opening 216*a* to receive trigger pin 217, a right gear pin opening 218*a* to receive gear pin 219, and a right hammer pin opening 220*a* to receive a hammer pin 221. Trigger pin 217 extends along a trigger axis 217 that extends substantially perpendicularly to central receiver plane 101. Hammer pin 221 extends along a hammer axis 264*x* of hammer 264 that extends substantially perpendicularly to central receiver plane 101. A plurality of receiver pockets or recesses 223 in right side wall inside face 206*a* are disposed in a circle around and spaced from gear pin opening 218*a*. Gear pin opening 218*a* extends along a gear axis 226*x* that extends substantially perpendicularly to central receiver plane 101. Each recess 223 is sized to receive a ball-nose spring plunger 224 that extends through right-side face 225 (shown in FIG. 5) of gear member 226.

Top wall portion 208 defines an adjustment screw opening 228 that receives an adjustment screw 230. Rear wall portion 210 defines an open trigger slot 234 to receive rear portion 238*b* of trigger 238. Rear wall portion 210 includes a trigger plunger pocket 240 extending partially therethrough from a lower wall end 241 where it meets adjustment screw opening 228. Trigger plunger pocket 240 is sized to receive trigger return spring 231, which is disposed over a portion of trigger return plunger 232. Front wall portion 212 defines a bolt release opening 242 through which bolt release pin 244 extends to attach to inward portion 124 of bolt release lever 120 (shown in FIG. 2). Bottom wall portion 214 defines a trigger opening 246.

In one embodiment, left housing portion 204 has a rectangular shape with a left housing upper portion 248 and a left housing lower portion 250. Left housing upper portion 248 has a reduced thickness 252 compared to left housing lower portion 250 and is discussed in more detail below with reference to FIG. 4. Left housing portion 204 has a left trigger pin opening 216*b* to accept trigger pin 217 and is aligned with right trigger pin opening 216*a*. A left gear pin opening 218*b* receives gear pin 219 and is aligned with right gear pin opening 218*a*. A left hammer pin opening 220*b* receives hammer pin 221 and is aligned with right hammer pin opening 220*a*.

Figure 4:
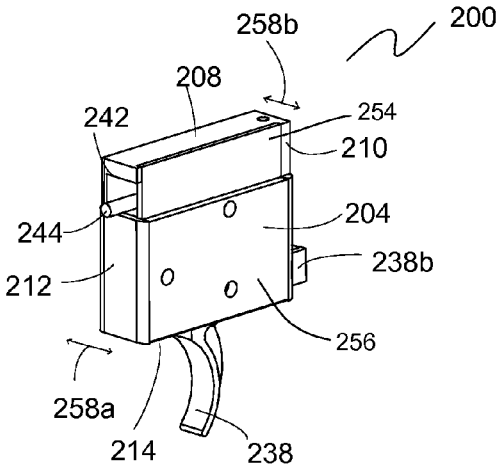
FIG. 4 illustrates the trigger box assembly of FIG. 3 in an assembled form.

Referring now to FIG. 4, trigger box assembly 200 is shown assembled. Left housing portion 204 abuts top wall portion 208 and bottom wall portion 214 between ends of front wall portion 212 and rear wall portion 210. Finger portion 238*c* of trigger 238 and extends downward through trigger opening 246 (not visible). Trigger rear portion 238*b* extends rearward through trigger slot 234 (not visible). Bolt release pin 244 extends through bolt release opening 242 to attach to bolt release lever 120. Trigger box lower portion 256 is sized and has an overall thickness 258*a* to be received by trigger well 103 of lower receiver 100 (shown in FIG. 2). Trigger box upper portion 254 has an overall thickness 258*b* that is reduced compared to overall thickness 258*a* and sized so that trigger box upper portion is received in a slot of the rifle upper receiver (not shown) in place of bolt carrier, bolt, and firing pin (a.k.a., the bolt carrier assembly, not shown).

Referring now to FIGS. 5 and 5A-5C, embodiments of each of the components of trigger mechanism 205 are illustrated exploded in a right, front, perspective view. Gear member 226 is described with additional reference to FIG. 5A, which shows a right, perspective view of gear member 226. In one embodiment, gear member 226 has a disk-shaped gear body 226*a* adjacent a toothed wheel 226*b* with a predefined number of teeth 226*c*. In other embodiments, gear member 226 is a toothed longitudinal bar, escapement gear, or ratchet.

Gear pin 219 extends axially through the center of gear body 226 and toothed wheel 226*b*. At least one gear spring 226*g* (shown in FIG. 5A) is disposed over gear pin 219 in abutment with toothed wheel 226*b*. Gear spring(s) 226*g* bias gear member 226 towards right housing portion 202. In one embodiment, gear springs 226*g* are five flat-spring washers where each provides a force of 1.0 lb. Thus, the total force of gear springs 226*g* is 5 lbs.

Toothed wheel 226*b* abuts gear body 226*a*. In one embodiment, gear body 226*a*, toothed wheel 226*b*, and locking member 226*e* are formed as one piece or fixed together as a single, integral unit. Toothed wheel 226*b* and gear body 226*a* rotate about gear pin 219. In one embodiment, toothed wheel 226*b* has thirty-one teeth 226*c* that define gear recesses 226*h* between adjacent teeth 226*c*. The number of gear teeth 226*c* corresponds to the number of rounds available in a magazine, plus one tooth for advancing gear member 226 when locking member 226*e* locks trigger 238 after "firing" the last round. Thus, thirty-one gear teeth 226*c* correspond to thirty trigger pulls (simulating thirty rounds fired) plus one tooth to reset or unlock trigger 238 after the thirtieth trigger pull by advancing gear member 226 one additional increment.

In other embodiments, toothed wheel 226*b* has more or fewer teeth as desired. For example, toothed wheel 226*b* may have thirty-two teeth and two locking pins 226*e* disposed 180 degrees from one another. Thus, while rotating 180°, gear member 226 would advance one increment for each of fifteen trigger pulls (simulating fifteen rounds in a magazine), plus one additional increment by depressing bolt release lever 120 to reset or unlock trigger 238 after the fifteenth trigger pull. Gear member 226 would then be in a rotational position to again increment once per trigger pull for fifteen trigger pulls, followed by an additional increment by depressing bolt release lever 120. Similarly, toothed wheel 226*b* may have 33 teeth and three locking pins 226*e* evenly disposed 120° from one another for three sections of ten trigger pulls and an additional increment by depressing bolt release lever 120 after the tenth trigger pull. Similar configurations are contemplated to simulate 5-round, 20-round, 26-round, 40-round and other capacity magazines.

Gear member 226 has one or more ball-nose spring plunger openings 226*d*, sized to receive a ball-nose spring plunger 224 therein. One or more ball-nose spring plungers 224 extend through toothed wheel 226*b* and gear body 226*a* and protrude from right face 225 of gear member 226 to engage recesses 223 in right housing portion 202. Thus, gear member 226 seats itself when advanced from one position to another position. Because each ball-nose spring plunger 224 extends into both of toothed wheel 226*b* and gear body 226*a*, ball-nose spring plungers 224 also prevent toothed wheel 226*b* from rotating with respect to gear body 226*a*. In one embodiment, four ball-nose spring plungers 224 are included, each having a force of 3.8 lbs. In another embodiment, only one ball-nose spring plunger 224 is included.

A locking member 226*e*, such as a pin or protrusion, extends radially from gear body 226*a* with a height 226*f* about equivalent to the distance between adjacent teeth 226*c*. Locking member 226*e* is sized to nearly abut hammer 264 when locking member 226*e* aligns with hammer 264 and, for example, pointing towards forward end portion 106 of lower receiver 100.

Trigger return plunger 232 extends along a longitudinal plunger axis 232*a* and has a plunger stem 232*b*, a plunger body 232*c*. A plunger end 232*d* is shown as rounded, but may have other shapes. Trigger return spring 231 slides over plunger stem 232*b* and abuts a plunger shoulder 232*e* at the intersection of plunger stem 232*b* and plunger body 232*c*. In one embodiment, trigger return spring 231 provides a 4.0 lb. trigger pull force in combination with hammer spring 266, pawl spring 274, and any other force acting against a pull of trigger 238. The trigger pull force can be adjusted as desired by selecting the appropriate springs or adjusting the compression of one or more springs. As noted above, adjustment screw 230 extends through right housing portion 202 to adjust the length of trigger pull and/or the compression of trigger return spring 231 between trigger return plunger 232 and right housing portion 202. Adjustment screw 230 may extend into trigger return spring 231 depending on how these components are shaped.

In one embodiment, bolt release pin 244 has a head 244*a* and a body 244*b*. In one embodiment, bolt release pin 244 is a 6-32 machine screw threadably engaged with opening 130 of bolt release lever 120. An optional bolt release collar 270 is screwed onto, slips over, or is otherwise attached to bolt release pin 244. Bolt release collar 270 has a cylindrical body 270*a* with an opening 270*b* (preferably threaded) extending axially therethrough. A bolt release finger or protrusion 270*b* extends from body 270*a* and is aligned when assembled to extend towards locking member 226*e* extending from gear member 226. The tip 270*d* of bolt release finger is angled at approximately forty-five degrees to bolt release finger 270*c* for optimal engagement with locking member 226*e* of gear member 226.

Figure 5:
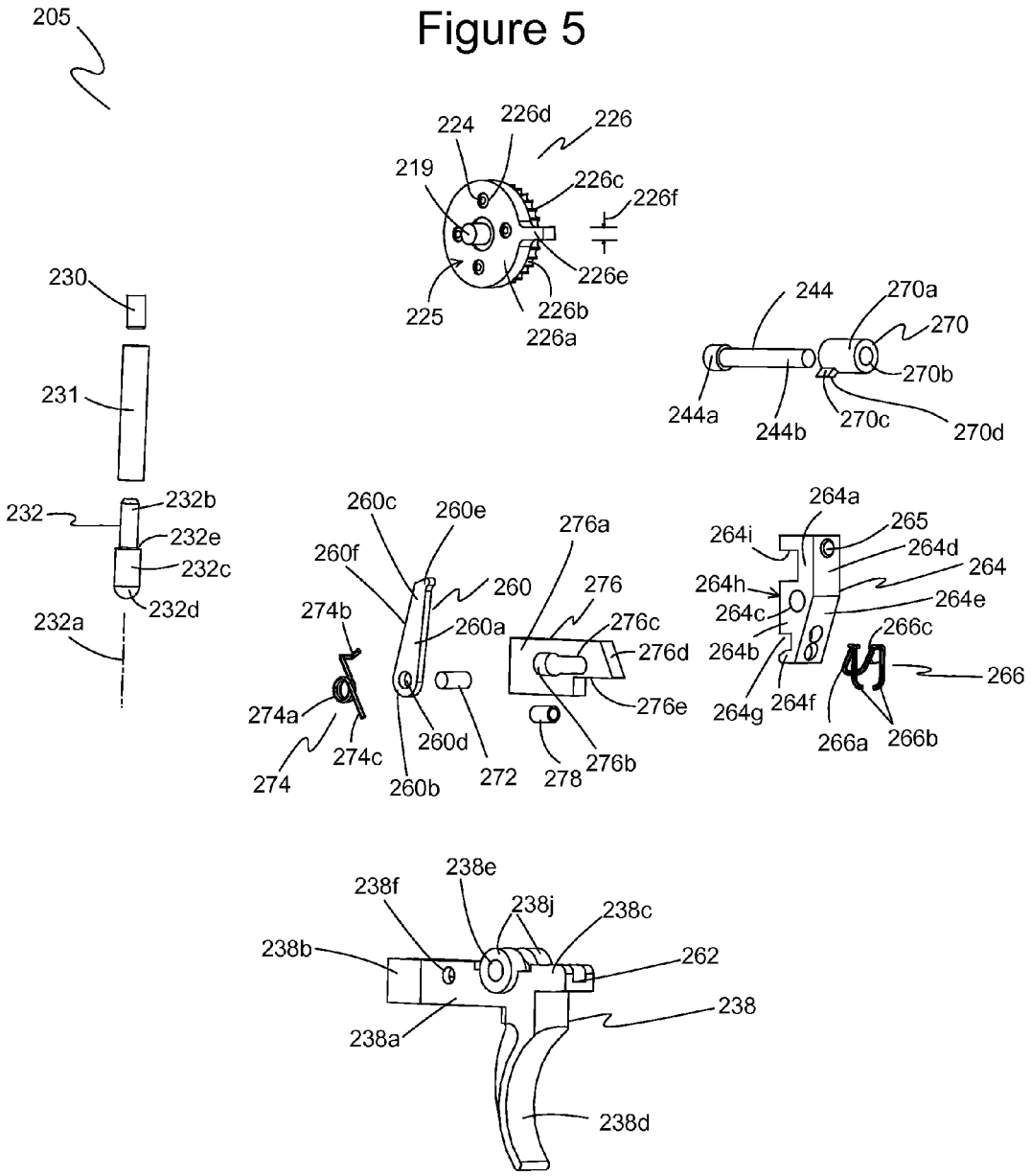
FIG. 5 illustrates an exploded left, front, perspective view of components of the trigger box assembly of FIG. 3.
Figure 5A:
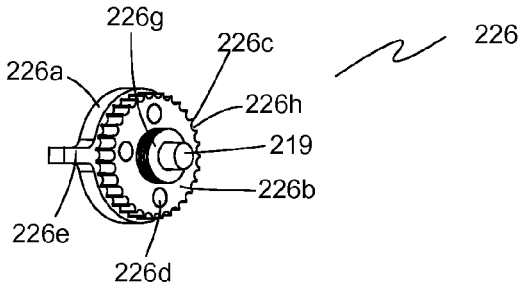
FIG. 5A illustrates a right, front, perspective view of a gear member of the present invention and shows gear springs and a locking pin.
Figure 5B:
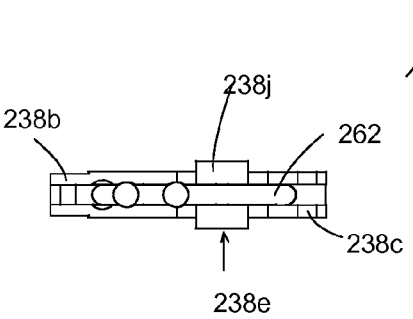
FIG. 5B illustrates a top view of one embodiment of a trigger of the present invention.
Figure 5C:
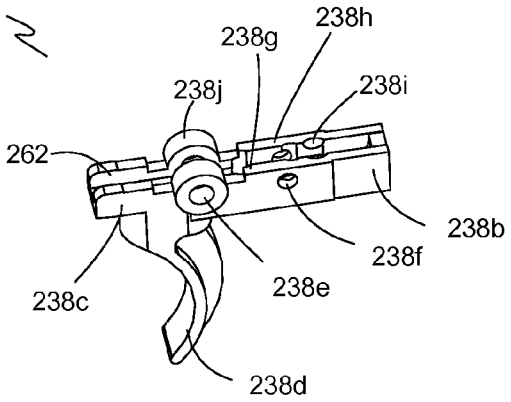
FIG. 5C illustrates a right-side, perspective view of the trigger of FIGS. 5 and 5B.

In one embodiment, pawl 260 has a flat, elongated body 260*a* that tapers from a first end 260*b* to a second end 260*c*. First end 260*b* has a pin opening 260*d* sized to receive pawl pin 272 therethrough. Second end 260*c* has a gear tip 260*e* that is sized and configured to engage toothed wheel 226*b* of gear member 226. A pawl spring 274 has a coil portion 274*a* between a catch portion 274*b* and a straight portion 274*c*. Coil portion 274*a* is positioned adjacent to and concentric with pin opening 260*d* to receive pawl pin 272. When assembled, catch portion 274*b* abuts rear edge 260*f* of pawl 260 and straight portion 274*c* extends into sear pocket 262 of trigger 238 (sear pocket is shown in FIGS. 5B, 5C). Thus, pawl spring 274 biases second end 260*c* of pawl 260 to pivot about pawl pin 272 towards forward end portion 106 of lower receiver 100. In one embodiment, pawl spring 274 provides a 2.0 lb. force.

In one embodiment, a trigger catch 276 has a flat, plate-like body 276*a* with an oval-shaped trigger pin opening 276*b* and a sear spring slot 276*c* extending therethrough. Trigger pin opening 276*b* merges with sear spring slot 276*c* to define a keyhole-shaped opening. Trigger catch 276 has a forward face 276*d* that slopes downward and forward over a notch 276*e*. A trigger pin 217 (shown in FIG. 6) extends through trigger pin opening 276*b* when trigger catch 276 is received in sear pocket 262 of trigger 238. Sear spring 278 (represented by a cylinder in FIG. 5) is received in sear spring slot 276*c* in abutment with trigger pin 217. Sear spring 278 biases trigger catch 276 to a forward position, causing trigger catch 276 to move forward after disengaging hammer 264 when trigger 238 is manipulated from the first trigger position to the second trigger position. Due to trigger pin opening 276 having an oval shape, trigger catch 276 is capable of moving forward and backward relative to trigger body 238*a* during and after trigger manipulation. When trigger 238 is initially manipulated, trigger catch 276 engages hammer 264, causing trigger catch 276 to move backward. As trigger 238 is fully manipulated from a first trigger position to a second trigger position (e.g., a pulled trigger position), trigger catch 276 disengages from hammer 264, allowing hammer 264 to rotate and "click" against front wall portion 212.

Hammer 264 has a first end portion 264*a* a second end portion 264*b*. A hammer pin opening 264*c* extends transversely through hammer 264 for receiving hammer pin 221 therethrough. Hammer 264 pivots about hammer pin 221 from a first hammer position to a second hammer position, where hammer 264 is biased towards the first hammer position by a hammer spring 266. A hammer adjustment screw 265 is received in an adjustment screw opening extending through first end portion substantially perpendicularly to first end forward face 264*d*. A second end forward face 264*e* slopes downward and rearward from first end forward face 264*d*. A hammer catch 264*f* is defined by a slot 264*g* in rear face 264*h* of second end portion.

In one embodiment, hammer spring 266 has a U-shaped portion 266*a* connected to a pair of legs 266*b* extending at an acute angle 266*c* from U-shaped portion. Hammer spring 266 is disposed between second end forward face 266*e* of hammer 264 and front wall portion 212 of right housing portion 202 to bias hammer 264 to the second hammer position with second end portion 264*b* in a rearward direction. In one embodiment, hammer spring 266 provides a 3.2 lb. force.

Trigger 238 is described with reference to FIGS. 5, 5B, and 5C. FIG. 5B illustrates a top view of trigger 238, where the right side of trigger 238 is towards the bottom of the page. FIG. 5C illustrates a left, front, perspective view of trigger 238. Trigger 238 has a trigger body 238*a* with a trigger rear portion 238*b* and a trigger front portion 238*c*. A curved trigger finger portion 238*d* extends transversely from trigger body 238*a*. Trigger body 238*a* has a trigger pin opening 238*e* and a finger pin opening 238*f* extending perpendicularly therethrough. Trigger 238 pivots about trigger axis 238*x* (shown in FIG. 3) between a first trigger position (e.g., a neutral position) and a second trigger position (e.g., a pulled trigger position), where trigger 238 is biased towards the first trigger position. Sear pocket 262 defines a trigger plunger pocket 240 along trigger body 238*a* and defines a left trigger wall 238*g* and a right trigger wall 238*h*. A plunger recess 238*i* extends into sear pocket 262 and partially into left and right trigger walls 238*g*, 238*h*. Plunger recess 238*i* receives body end 232*d* of trigger return plunger 232. Round protrusions 238*j* extend laterally from trigger body 238*a* and are centered on trigger pin opening 232*e*, which also extends therethrough.

Figure 6:
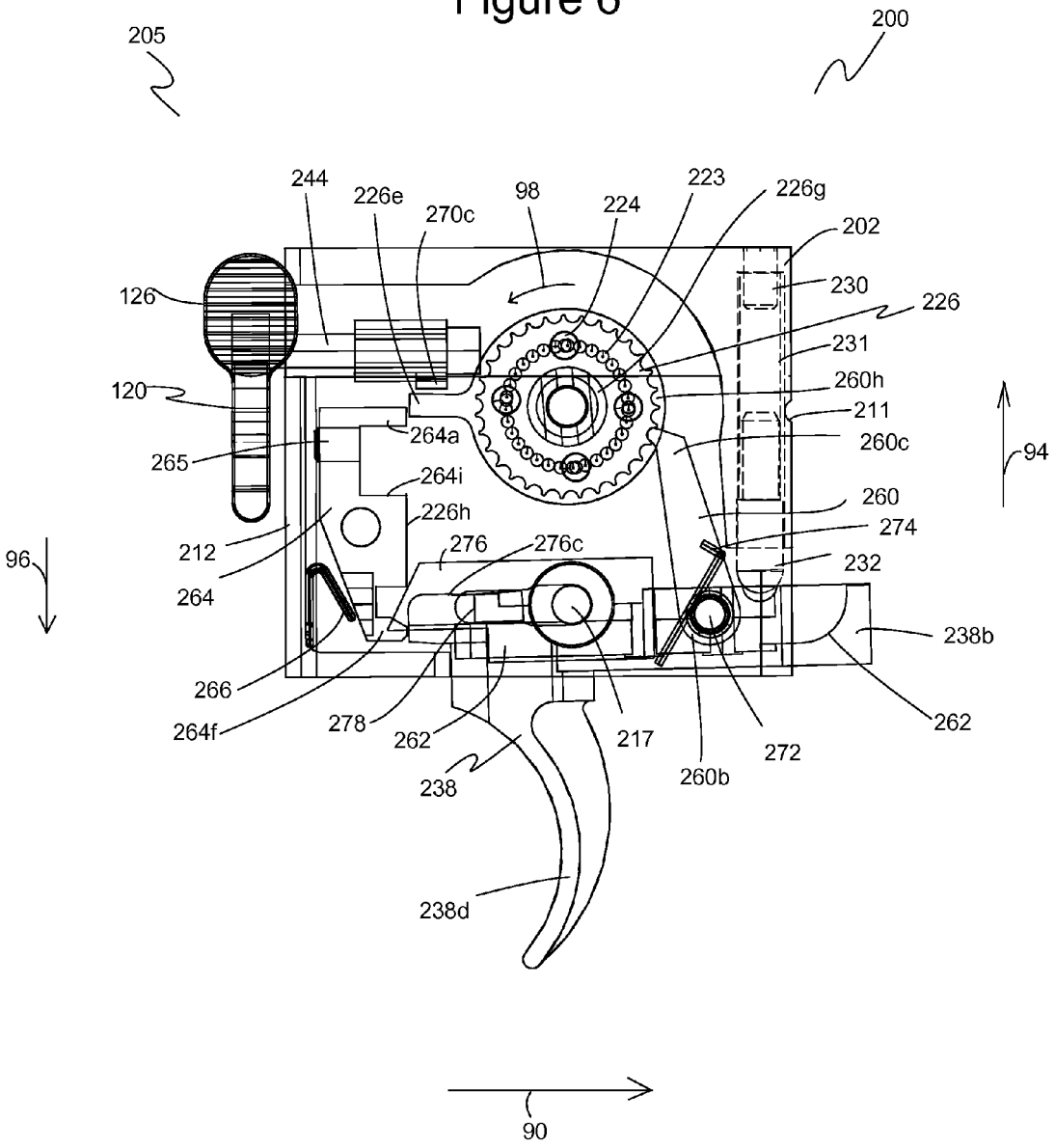
FIG. 6 illustrates a left-side view of a trigger box assembly of the present invention showing components of the trigger box assembly and a bolt release lever.

Referring now to FIG. 6, a left side elevation shows components of trigger mechanism 205 assembled with right housing portion 202. Trigger 238 is shown locked in the first trigger position, where locking member 226*e* is aligned to abut first end portion 264*a* of hammer 264 just above cutout 264*i*. Pressing bolt release lever 120 will rotate bolt release pin 244, thereby causing bolt release finger 270*c* to contact locking member 226*e* and advance gear member 226 one increment to an unlocked position.

Trigger catch 276 is received in sear pocket 262 of trigger 238 and retained by trigger pin 217. Sear spring 278 (represented by a rectangle in FIG. 6) is received in sear spring slot 276*c*. First end 260*b* of pawl 260 is also received in sear pocket 262 and retained by pawl pin 272. Pawl spring 274 biases pawl 260 to pivot forward about pawl pin 272 so that second end 260*c* of pawl 260 engages gear member 226.

Hammer spring 266, trigger return spring 231, ball-head spring plungers 234, gear springs 226*g*, and pawl spring 274 described above are chosen to provide a 4 lb. trigger and other trigger characteristics of military-issue rifles. These springs may be selected with other forces to provide performance of trigger 238 that meets the user's preference, where the trigger pull force is between about 2 pounds and about 8 pounds and preferably about 4 pounds.

In one embodiment, gear member 226, pawl 260, hammer 264, trigger catch 276, bolt release collar 270, and bolt release lever 120 are machined from steel and heat treated to a Rockwell C hardness of 45-50. Right housing portion 202 and left housing portion 204 are preferably machined from cold rolled steel. In one embodiment, return plunger 232 is made of nylon. In one embodiment, lower receiver 100, receiver extension tube 102, and magazine block 110 are cast of aluminum as a single unit, but optionally are made as separate parts to be assembled. Other materials are acceptable.

In one embodiment, rear wall portion 210 of housing 201 defines a dowel pin recess 211 sized to receive a housing retaining pin 211*a* (not shown) that extends through lower receiver 100 to maintain trigger box assembly 200 in trigger well 103. More than one dowel pin recess 211 may be used and dowel pin recess(es) 211 may be positioned as needed. After inserting trigger box assembly 200 into trigger well 103, housing retaining pin 211*a*, such as a fastener, dowel pin, or the like, is inserted through an opening in lower receiver and dowel pin recess 211 to lock trigger box assembly in place. In another embodiment, housing 201 has one or more openings that may be used to secure trigger box assembly 200 using fasteners, dowel pins, or the like that extend through or into housing 201.

While one embodiment of trigger box assembly 200 includes right housing portion 202 and left housing portion 204, it is contemplated that lower receiver 100 could be modified to retain the components of trigger mechanism 205 discussed above without the need for either or both of housing portions 202, 204. For example, lower receiver 100 may be bored with openings to receive trigger pin 217, hammer pin 221, gear pin 219, and other components with the addition of spacers, bushings, and other parts as needed.

Figure 7:
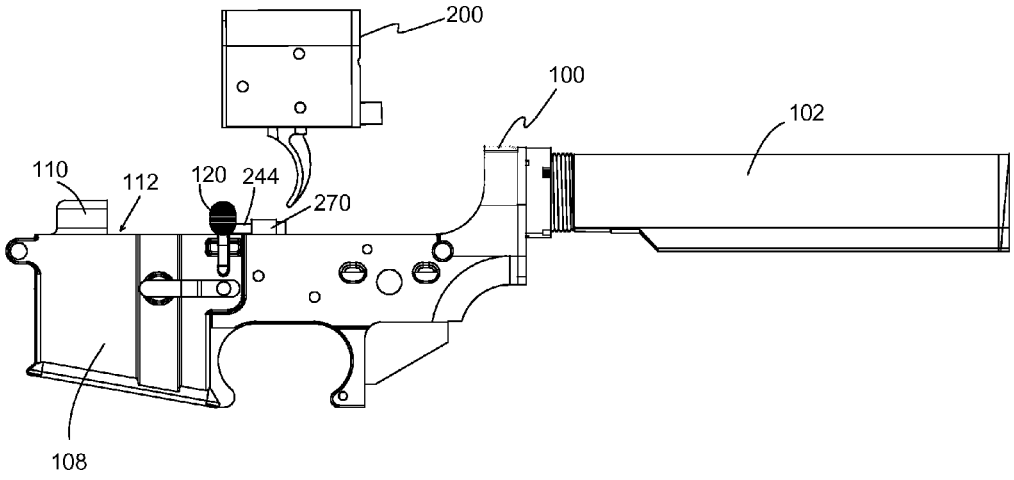
FIG. 7 illustrates a right-side view of a lower receiver and trigger box assembly of the present invention showing the trigger box assembly removed from the lower receiver.

Referring now to FIG. 7, a right-side elevation illustrates lower receiver 100 with buffer tube 102 and trigger box assembly 200 removed from lower receiver 100. Magazine block 110 on lower receiver 100 obstructs upper opening 112 of magazine well 108. Bolt release pin 244 with bolt release collar 270 is attached to bolt release lever 120.

Figure 8:
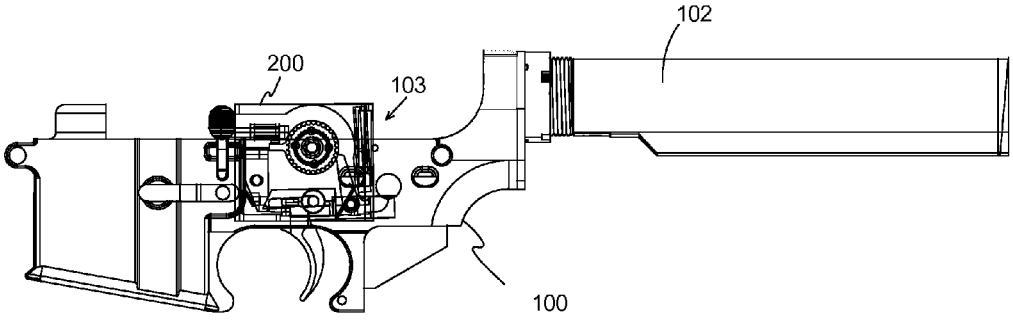
FIG. 8 illustrates a right-side, sectional view of a lower receiver of the present invention showing a trigger box assembly installed in the trigger well.

FIG. 8 illustrates a left-side, elevational, wireframe view of lower receiver 100 including buffer tube 102 and trigger box assembly 200 installed in trigger well 103.

Figure 9:
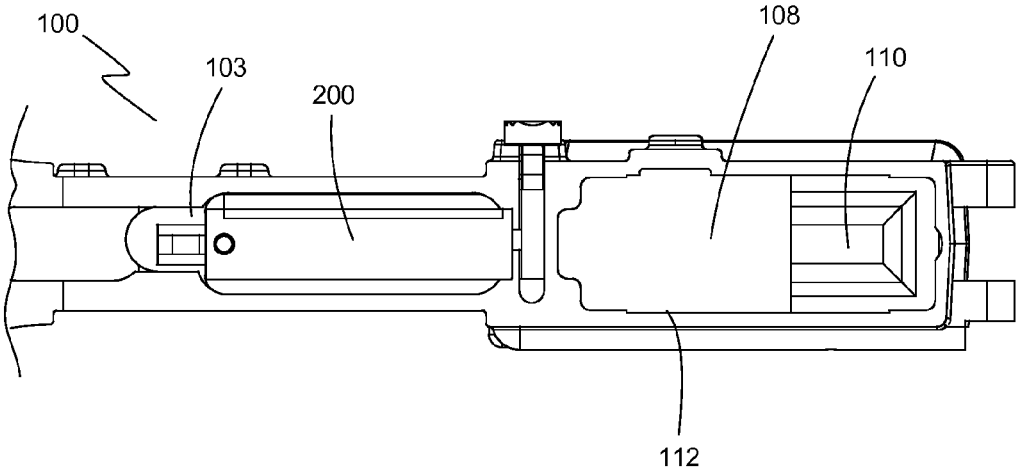
FIG. 9 illustrates a left-side, sectional view of a lower receiver of FIG. 8 showing a trigger assembly installed in the trigger well.

FIG. 9 illustrates a top view of a part of lower receiver 100 with trigger box assembly 200 installed in trigger well 103. Magazine block 110 obstructs upper opening 112 of magazine well 108.

Figure 10:
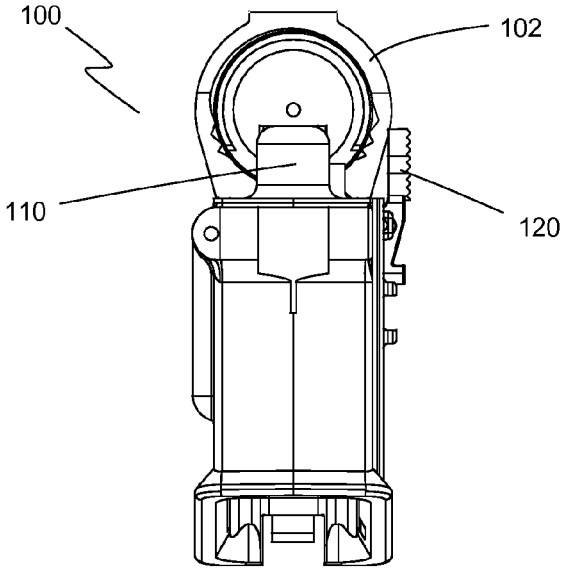
FIG. 10 illustrates a front elevational view of a lower receiver of FIG. 8 showing the magazine block attached over the upper opening of the magazine well.

FIG. 10 illustrates a front view of lower receiver 100 showing magazine block 110, bolt release lever 120, and buffer tube 102.

Figure 11:
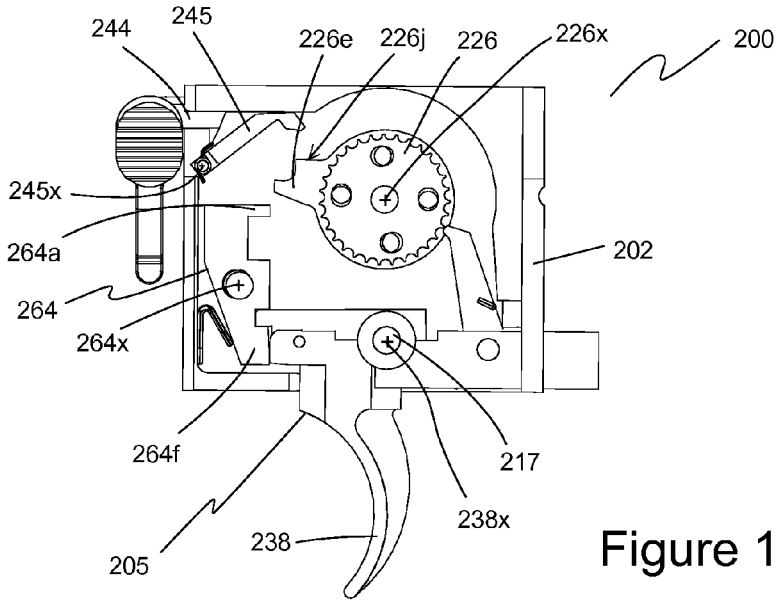
FIG. 11 illustrates a left-side view of a trigger box assembly with trigger mechanism showing the trigger mechanism in an unlocked position.

FIG. 11 illustrates another embodiment of trigger box assembly 200 with trigger assembly 205 and right housing portion 202. Trigger assembly 205 is in an unlocked position, where locking member 226*e* of gear member 226 is not aligned to abut hammer 264. Trigger 238 pivots about trigger axis 238*x*, hammer 264 pivots about hammer axis 264*x*, and gear member 226 pivots about gear axis 226*x*. After manipulating trigger 238 one fewer time than a predefined number of manipulations (e.g., pulling trigger 238 the $29^{th}$ of 30 times from the first trigger position to the second trigger position), locking member 226*e* is advanced to a position where it is one increment from abutting first end portion 264*a* of hammer 264. One additional trigger pull will advance gear member 226 to align locking member 226*e* with first end portion 264*a* of hammer 264. When aligned to abut hammer 264, locking member 226*e* prevents hammer 264 from rotating about hammer axis 264*x*, thereby locking trigger assembly 205 due to hammer catch 264*f* preventing trigger 238 from pivoting about trigger pin 217/trigger axis 238*x*.

In this embodiment, locking member 226*e* of gear member 226 has an upper surface 226*j* to contact a gear actuator 245 that is pivotably connected to right and/or left housing portion 202, 204. When gear actuator 245 pivots about actuator axis 245*x* downward towards locking member 226*e*, it contacts upper surface 226*j* to advance gear member 226 out of a locked position to an unlocked position.

Figure 13:
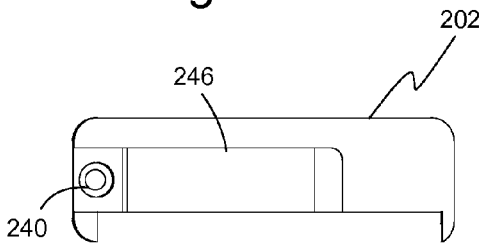
FIG. 13 illustrates a bottom view of the right housing portion of FIG. 12.
Figure 12:
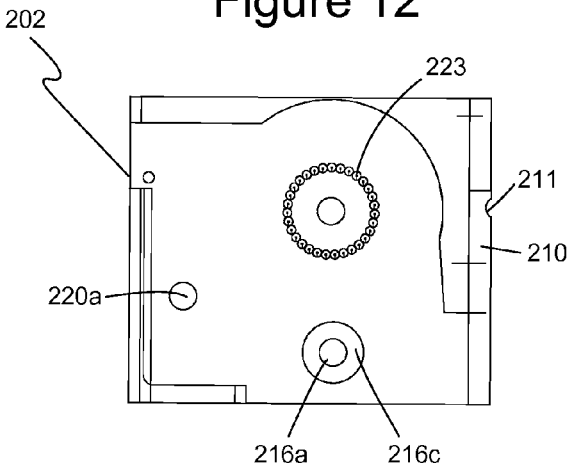
FIG. 12 illustrates a left-side view of a right housing portion of the present invention showing recesses and openings therein.
Figure 14:
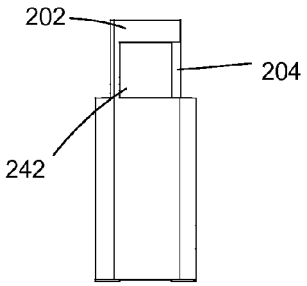
FIG. 14 illustrates a front elevational view of one embodiment of a housing of the present invention showing the bolt release opening.

FIGS. 12-14 illustrate embodiments of right and left housing portions 202, 204. FIG. 12 illustrates a right-side elevation showing an inside surface of right housing portion 202 with recesses 223, right hammer pin opening 220*a*, right trigger pin opening 216*a*, and a right trigger recess 216*c*. Rear wall portion 210 defines housing recess 211 that receives a dowel pin or the like to retain trigger box assembly 200 in lower receiver 100.

FIG. 13 illustrates a bottom view of right housing portion 202 showing trigger plunger pocket 240 and trigger opening 246. FIG. 14 illustrates a front elevation of right and left housing portions 202, 204 assembled to one another and defining bolt release opening 242. In one embodiment, bolt release pin 244 extends through bolt release opening 242 to operate gear member 226.

Figure 15:
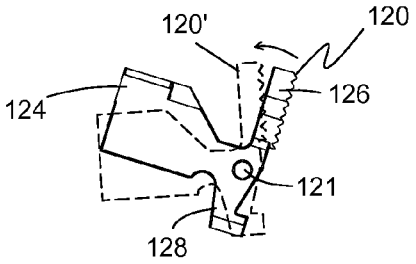
FIG. 15 illustrates a front elevational view of one embodiment of a bolt release lever of the present invention showing the lever portion and the inner portion in a neutral position and in a first position.

FIG. 15 illustrates a front elevational view of one embodiment of bolt release lever 120 with upper lever part 126, lower lever part 128, and inward portion 124. In solid lines, bolt release lever 120 is shown in a neutral position; in broken lines, bolt release lever 120' is shown in a first position where upper lever portion is pressed inward toward lower receiver 100 (shown in FIG. 2). Bolt release lever 120 pivots about opening 121 when attached to lower receiver 100 (shown in FIG. 2). Bolt release lever 120 also includes bolt release pin 244 (shown in FIG. 16) that extends from inward portion 124 towards gear member 226 (shown in FIG. 16).

Figure 16:
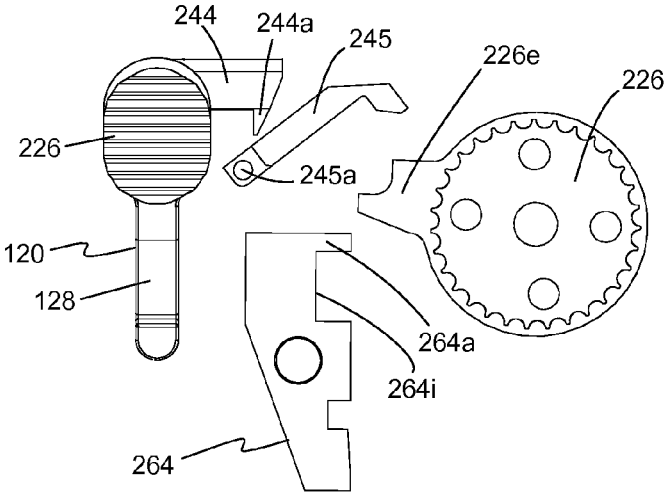
FIG. 16 illustrates a left-side elevation showing components of one embodiment of a trigger mechanism and bolt release lever.
Figure 17:
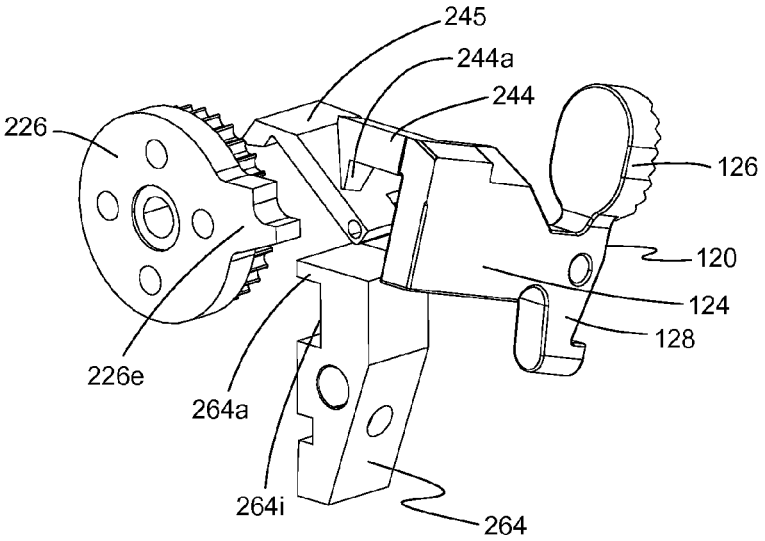
FIG. 17 illustrates a left, perspective view of the trigger mechanism and bolt release lever of FIG. 16.

FIG. 16 illustrates a right-side elevation of bolt release lever 120 of FIG. 15 and embodiments of gear actuator 245, gear member 226, and hammer 264. FIG. 17 illustrates a left, front perspective view of bolt release lever 120, bolt release pin 244, gear actuator 245, gear member 226, and hammer 264. Bolt release lever 120 includes bolt release pin 244 extending rearwardly from inward portion 124 of bolt release lever 120. Bolt release pin 244 includes a protrusion 244*a* that extends downwardly to contact gear actuator 245 when a user presses upper lever part 126 of bolt release lever 120. In FIGS. 16 and 17, gear member 226 is shown in an unlocked position as discussed above with reference to FIG. 11.

Figure 18:
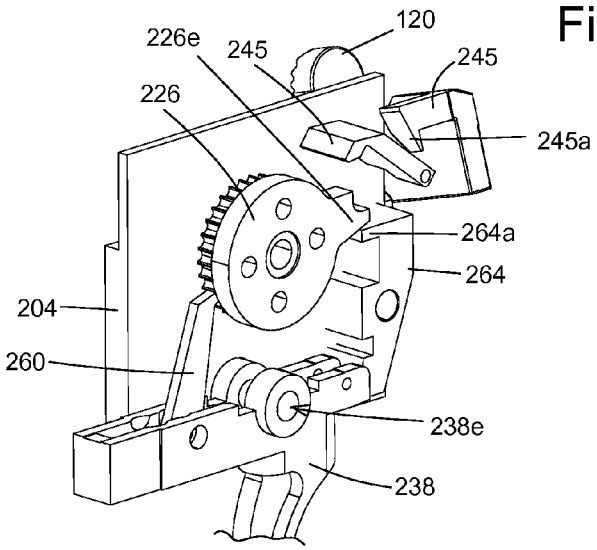
FIG. 18 illustrates a right, rear, perspective view of a left housing portion and the trigger mechanism and bolt release lever of FIG. 16 shown with the trigger mechanism in an unlocked position.
Figure 19:
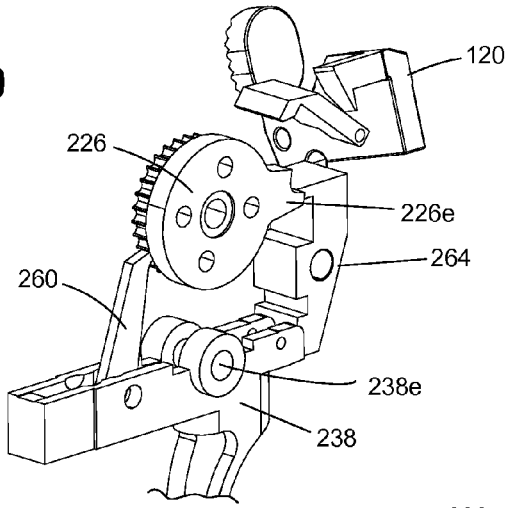
FIG. 19 illustrates a right, rear, perspective view of the left housing portion and the trigger mechanism and bolt release lever of FIG. 16 shown with the trigger mechanism in a locked position.
Figure 20:
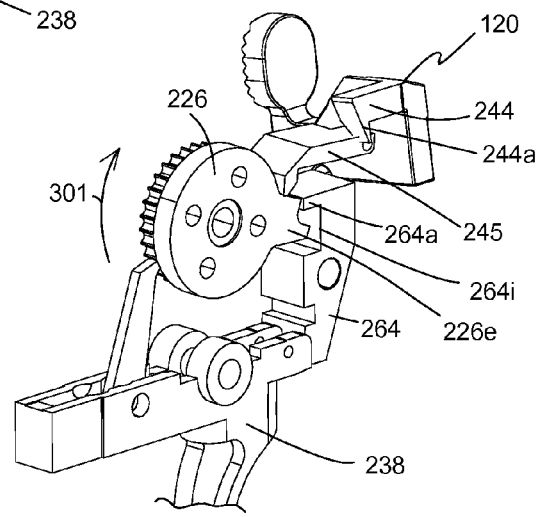
FIG. 20 illustrates a right, rear, perspective view of a left housing portion and the trigger mechanism and bolt release lever of FIG. 16 shown with the bolt release lever pressed to advance the gear member to an unlocked position.

FIGS. 18-20 illustrate right, rear, perspective views of gear member 226, bolt release lever 120, gear actuator 245, hammer 264, trigger 238, and pawl 260. FIG. 18 also shows left housing portion 204. FIG. 18 shows gear member 226 and trigger 238 in an unlocked position where manipulation of trigger 238 will allow hammer 264 to pivot without contacting locking member 226*e*.

FIG. 19 shows gear member 226 and trigger 238 in a locked position where locking member 226*e* is aligned to abut hammer 264. Pawl 260 engages gear member 226 and hammer 264 is prevented from moving due to making contact with locking member 226*e*, therefore, trigger 238 also cannot pivot about trigger pin 217 (shown in FIG. 6) extending through trigger pin opening 238*e*. Bolt release lever 120 is not pressed in. Since trigger 238 is locked, pawl 260 cannot advance gear member 226.

FIG. 20 shows bolt release lever 120 in a second position (e.g., a pressed-in position) with protrusion 244*a* of bolt release pin 244 contacting gear actuator 245 and causing gear member 226 to rotate in a direction shown by arrow 301. When protrusion 244*a* contacts gear actuator 245, gear actuator 245 pivots downward to contact locking member 226*e* of gear member 226, therefore advancing gear member 226 from a locked position to an unlocked position with locking member 226*e* positioned to be out of alignment with first end portion 264*a* of hammer 264. More specifically, locking member 226*e* is moved or rotated so that locking member 226*e* aligns with cutout 264*i* of hammer 264 or otherwise out of alignment to engage hammer 264. As a result, hammer is permitted to pivot when trigger 238 is manipulated (i.e., moved from first trigger position to a second trigger position) and trigger 238 is not locked.

To use embodiments of lower receiver 100 discussed above, the user removes the lower receiver and bolt assembly from a fully-operational rifle. The user then assembles lower receiver 100 with trigger box assembly 200 to the upper receiver of the fully-operational rifle as conventionally performed. Referring to FIG. 6, when the user pulls finger portion 238*d* of trigger 238 backward (indicated by arrow 90), trigger rear portion 272*b* pivots upward (indicated by arrow 94) about trigger pin 217 and causes pawl 260 to rotationally advance gear member 226 by one increment. As gear member 226 rotates in a counter-clockwise direction (indicated by arrow 98) as viewed from the left side as in FIG. 6, second end 260*c* of pawl 260 moves backward 90 until it clears a tooth 226*c*, then is biased forward by pawl spring 274 to occupy the next gear recess 260*h* and also prevent rotation of gear member 226 in the opposite direction. When moving between each increment, gear member 226 moves slightly towards left housing portion 204 (not shown) against the bias of gear spring 226*g*. At each rotational increment, one or more ball-nose spring plungers 224 align to occupy recesses 223 to seat the position of gear member 226.

Also during a trigger pull, trigger catch 276 rotates downward (indicated by arrow 96) against hammer catch 264*f*, causing hammer 264 to rotate against hammer spring 266. As trigger 238 is further pulled, trigger catch 276 will disengage from hammer 264, thereby releasing hammer 264 to rotate to the first hammer position with adjustment screw contacting front wall portion 212. When the user releases trigger 238, trigger return plunger 232 biases trigger 238 to return to its first trigger position with forward face 276*d* of trigger catch 276 abutting rear face 264*h* of hammer 264. As it does so, forward face 276*d* of trigger catch 276 presses against trigger catch 264*f* and moves slightly backward 90 against the bias of sear spring 278.

With each pull or movement of trigger 238 from the first trigger position to the second trigger position, gear member 226 rotates one increment until locking member 226*e* aligns with hammer 264 to "lock out" trigger 238 by preventing rotation of hammer 264 in response to a pull of trigger 238. When trigger 238 is locked, the user cannot pull trigger 238 as is the case with a live-fire rifle with an empty magazine. As would be done with a fully operational rifle, the user would then eject magazine 34 and insert a loaded magazine 34 into magazine well 108. The user would then press upper lever part 126 of bolt release lever 120. In some embodiments of the present invention, pressing bolt release lever 120 pivots bolt release pin 244 and causes bolt release finger 270*c* of bolt release collar 270 to push down on locking member 226*e*. Therefore, gear member 226 is advanced so that locking member 226*e* is aligned with cutout 264*i* of hammer 264, thereby unlocking trigger 238 and permitting rotation of gear member 226. In other embodiments, pressing bolt release lever 120 pivots bolt release pin 244 to contact gear actuator 245, which contacts locking member 226*e* and advances gear member 226 to an unlocked position.

Figure 21:
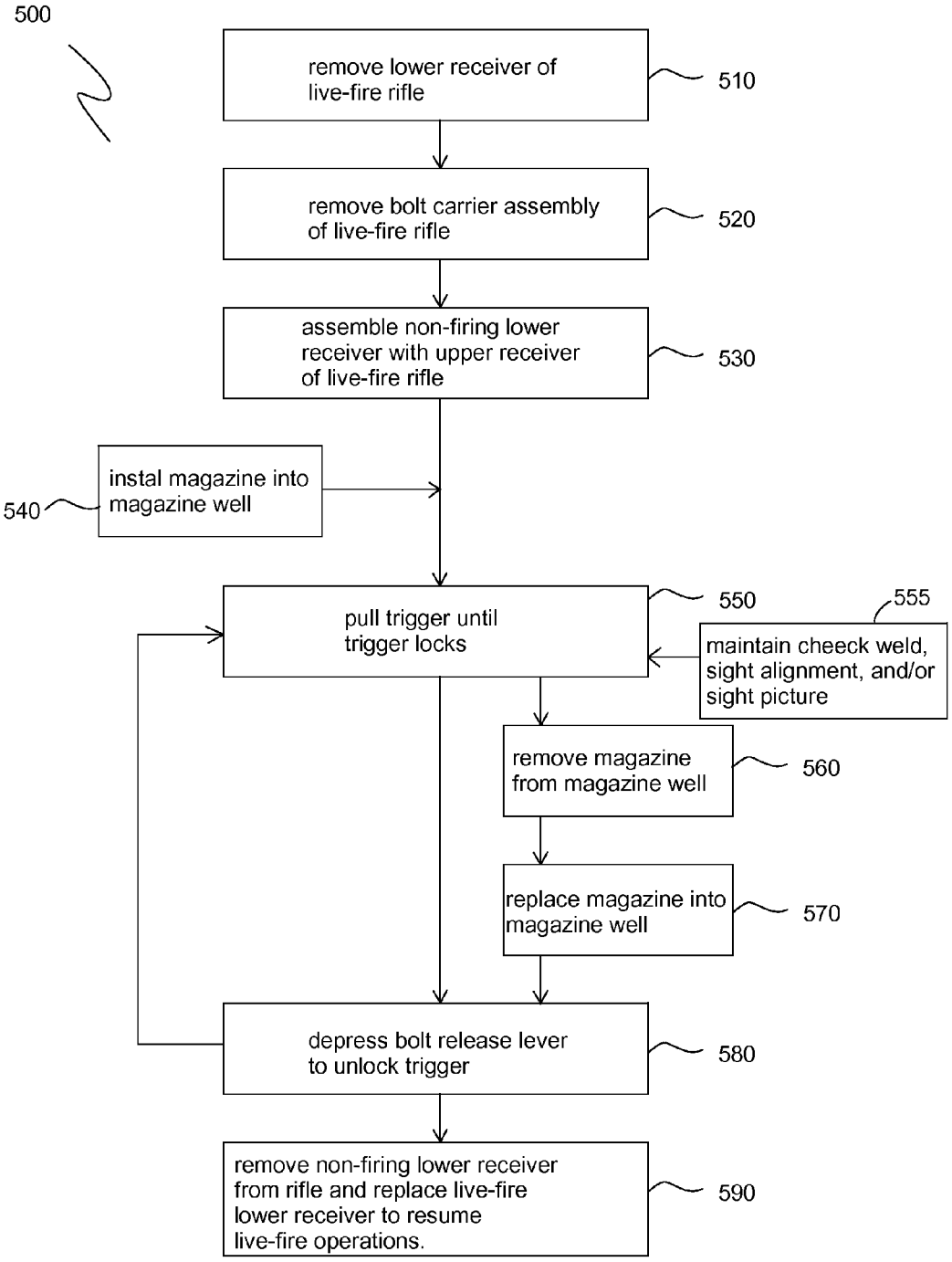
FIG. 21 illustrates a flowchart showing steps of one embodiment of a method of dry-fire training of the present invention.

Referring now to FIG. 21 in combination with FIGS. 1-20, embodiments of lower receiver 100 discussed above may be used to perform a method 500 of dry-fire training. Reference numbers discussed in method 500 refer by example to apparatuses that can be used to perform method 500; other apparatuses capable of performing method 500 are acceptable. Method 500 of dry-fire training is applicable to AR-15 rifles and other rifles having an upper receiver, a lower receiver, and a bolt carrier assembly.

In one embodiment, method 500 includes step 510 of removing a lower receiver of the live-fire rifle 10. Step 510 is performed when converting a live-fire rifle 10 to a non-firing rifle for dry-fire training since removing the lower receiver 14 of the live-fire rifle 10 enables the user to assemble lower receiver 100 to the upper receiver 12 of the live-fire rifle 10.

In step 520, the user removes the bolt carrier assembly 20 from the live-fire rifle 10. It is contemplated within the scope of method 500 that the non-firing training receiver could be configured so that carrier bolt assembly 20 would not need to be removed, but that the non-firing training receiver still blocks a round from being chambered. For example, trigger mechanism 205, housing 201 are positioned to allow for carrier bolt assembly 20 and magazine block 110 is positioned within magazine well so as to permit insertion of a magazine (loaded or unloaded) while also preventing a round from being chambered. In such an embodiment of the non-firing training receiver, removing the bolt carrier assembly 20 would be optional. Similarly, if the non-firing training receiver lacked a magazine block 110, removing the carrier bolt assembly 20 would be optional.

In step 530, a non-firing training receiver, such as lower receiver 100, is assembled to the upper receiver 12 of the live-fire rifle 10. In one embodiment of method 500, the non-firing training receiver has a trigger mechanism configured to increment a gear member 226 once for each trigger pull up to a predefined number. Upon reaching the predefined number of trigger pulls, the gear member 226 locks trigger mechanism 205.

In step 540, the user optionally installs a magazine 34 into magazine well 108 of lower receiver 100. Since the non-firing training receiver functions without a magazine 34 installed into the magazine well 108, step 540 is optional.

In step 550, while practicing marksmanship skills, such as sight alignment and body position, the user pulls trigger 238 to dry fire the rifle 10 as needed or until trigger 238 becomes locked, simulating that the rifle 10 is out of ammunition. In optional step 555, the user maintains one or more of a cheek weld, a sight alignment, and/or a sight picture for at least two consecutive trigger pulls.

In step 560, the user optionally releases and removes the magazine from magazine well 108. Step 560 may be performed at the end of a training session or when trigger 238 becomes locked due to reaching the maximum number of trigger pulls. In step 570, to continue training the user optionally replaces the magazine with another magazine or with the same magazine and installs the magazine in the magazine well 108. As noted above, since the non-firing training receiver functions without a magazine 34 installed into the magazine well 108, steps 560 and 570 are optional.

In step 580, the user depresses a lever, such as bolt-release lever 120, to unlock trigger 238. Unlocking trigger 238 positions gear member 226 at the start position for the predefined number of trigger pulls. Training steps 550-580 may be repeated as desired. Upon completion of training, or when the user is required to return to live-fire operation, the user in step 590 removes the non-firing lower receiver (e.g., lower receiver 100) and assembles the lower receiver 14 of the live-fire rifle 10 onto the rifle 10 to resume live-fire operations. Step 590 may be performed after any step of method 500.

Embodiments of lower receiver 100 and method 500 are intended to be used with a host weapon that is any rifle, carbine, or submachine gun having a removable lower receiver that contains the fire control or trigger mechanism 205 and a magazine well 108 or magazine attachment apparatus, where the magazine well 108 is positioned forward of the trigger mechanism 205.

The present invention provides a substantial replica of the host weapon's lower receiver that disables the host weapon's live-fire capability. Lower receiver 100 can be assembled with the host weapon's upper receiver by removing the host weapon's bolt carrier and bolt or breach block and assembling lower receiver 100 with upper receiver 12 of the host weapon 10. In one embodiment, the host weapon's bolt carrier and bolt or breach block is replaced with a non-firing replica bolt and bolt carrier replica that is built to mate with lower receiver 100.

Lower receiver 100 provides trigger manipulations consistent with the host weapon's standard magazine capacity. The process of manipulating the replica controls (e.g., trigger 238, bolt release lever 120) can be repeated after the user performs the host weapon's reloading sequence. In some embodiments, lower receiver 100 has the standard training colors of blue and red. Therefore, it is visibly identifiable by color from a distance.

Being able to manipulate the trigger, then regain proper sight alignment and sight picture, is critical to the user's proficiency with his or her own weapon. Marksmanship training or weapons qualification training can now be conducted consistent with the live-fire training sequence, or "course of fire." The user is afforded the opportunity to utilize the custom features of his/her personal weapon. Sights, optics, barrel lengths, and weights of one's live-fire weapon are the same as used for dry-fire training. The individual simply replaces the lower receiver and bolt/bolt carrier with lower receiver 100 of the present invention and conducts dry fire training. The present invention provides quick change modularity. Further, the user's custom features associated with a lower receiver, such as after-market grips, stocks, and ambidextrous controls, are compatible with lower receiver 100 of the present invention.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

We claim:

1. A rifle lower receiver for dry fire training comprising:

a lower receiver body having a trigger well, a magazine well disposed forward of the trigger well, and defining a central receiver plane substantially bisecting the trigger well and the magazine well, the lower receiver body being configured to be assembled with a rifle upper receiver having a chamber and being configured to receive a magazine in the magazine well; and a trigger assembly connected to the lower receiver body and having at least one locked position and a plurality of unlocked positions, the trigger assembly comprising:

a trigger with a trigger body portion and a trigger finger portion, the trigger body portion disposed at least partially within the trigger well, wherein the trigger is pivotable about a trigger axis extending substantially perpendicular to the central receiver plane between a first trigger position and a second trigger position when the trigger assembly is in the unlocked position, the trigger being biased towards the first trigger position;

a hammer disposed in the trigger well and pivotable about a hammer axis extending substantially perpendicularly to the central receiver plane from a first hammer position to a second hammer position in response to pivoting the trigger from the first trigger position to the second trigger position, and the hammer being biased towards the first hammer position;

a gear member disposed at least partially within the trigger well and incrementally rotatable about a gear axis extending substantially perpendicularly to the central receiver plane, the gear member having a plurality of gear teeth and a locking member extending from the gear member; and a pawl pivotably connected to the trigger body portion and extending to operably engage the gear member, wherein pivoting the trigger from the first trigger position to the second trigger position causes the pawl to rotationally advance the gear member one gear increment; and a bolt release lever attached to the lower receiver body and operable between a neutral lever position and a first lever position, wherein moving the bolt release lever from the neutral lever position to the first lever position rotationally advances the gear member one increment, and when the trigger assembly is in the at least one locked position, moving the bolt release lever from the neutral lever position to the first lever position advances the gear member to one of the plurality of unlocked positions; and wherein pivoting the trigger from the first trigger position to the second trigger position a predefined number of times places the trigger assembly in the at least one locked position in which the locking member is aligned to abut the hammer, thereby preventing the trigger from pivoting; and wherein the rifle lower receiver is incapable of firing ammunition.

2. The rifle lower receiver of claim 1, further comprising a housing at least partially disposed within the trigger well, the housing at least partially containing the hammer, the gear member, the pawl, and the trigger.

3. The rifle lower receiver of claim 1, wherein the gear member is selected from the group consisting of an escapement gear, a toothed wheel, a ratchet, and a toothed longitudinal bar.

4. The rifle lower receiver of claim 1 further comprising:

a housing at least partially disposed within the trigger well and defining a plurality of pin recesses on an inside wall surface, the housing at least partially containing the hammer, the gear member, the pawl, and the trigger; and at least one ball spring pin biased to extend into the plurality of recesses, wherein advancing the gear member one increment changes a position of the at least one ball spring to an adjacent one of the plurality of recesses.

5. The rifle lower receiver of claim 1 further comprising a magazine block disposed to obstruct an upper opening of the magazine well, wherein the magazine block prevents a round from entering the chamber of the rifle upper receiver.

6. The rifle lower receiver of claim 5, wherein the magazine block is permanently attached to the rifle lower receiver.

7. The rifle lower receiver of claim 1, wherein the trigger has a trigger pull force from about 2 to about 8 pounds.

8. The rifle lower receiver of claim 7, wherein the trigger has a trigger pull force of about 4 pounds.

9. The rifle lower receiver of claim 1, further comprising:

a bolt release pin extending rearwardly from the bolt release lever;

a gear member actuator pivotable about an actuator axis extending substantially perpendicularly to the central receiver plane from a first actuator position to a second actuator position, the gear member actuator being biased towards the first actuator position and capable of contacting the locking member;

wherein moving the bolt release lever from the neutral lever position to the first lever position moves the bolt release pin into engagement with the gear member actuator, thereby pivoting the gear member actuator to the second actuator position and advancing the gear member one increment.

* * * * *